US005967695A

United States Patent [19]

Vural

[11] Patent Number: 5,967,695

[45] Date of Patent: Oct. 19, 1999

[54] VEHICLE FOR REPAIRING ROAD SURFACES

[75] Inventor: Gülertan Vural, Emmelshausen, Germany

[73] Assignee: Wacker Werke GmbH & Co. KG, München, Germany

[21] Appl. No.: 08/737,039

[22] PCT Filed: Feb. 27, 1996

[86] PCT No.: PCT/EP96/00793

§ 371 Date: Dec. 20, 1996

§ 102(e) Date: Dec. 20, 1996

[87] PCT Pub. No.: WO96/27048

PCT Pub. Date: Sep. 6, 1996

[30] Foreign Application Priority Data

Feb. 27, 1995 [DE] Germany ..... 195 06 788

[51] Int. Cl.[6] ..... E01C 23/06

[52] U.S. Cl. ..... 404/77; 404/84.1; 404/90; 404/95; 404/117; 404/120

[58] Field of Search ..... 404/84.05, 84.1, 404/90, 91, 101, 102, 103, 114, 117, 128

[56] References Cited

U.S. PATENT DOCUMENTS

| | | | |
|---|---|---|---|
| 3,055,280 | 9/1962 | Neville | 404/95 |
| 3,907,450 | 9/1975 | Cutler . | |
| 4,260,280 | 4/1981 | Hirn et al. | 404/122 |
| 4,534,674 | 8/1985 | Cutler | 404/101 X |
| 4,871,025 | 10/1989 | Mayfield et al. | 404/101 X |
| 5,190,400 | 3/1993 | Sterner | 404/117 X |
| 5,294,210 | 3/1994 | Lemelson | 404/84.1 |
| 5,348,418 | 9/1994 | Campbell | 404/103 |

FOREIGN PATENT DOCUMENTS

| | | |
|---|---|---|
| 2087879 | 7/1993 | Canada . |
| 0560021 | 9/1993 | European Pat. Off. . |
| 1222095 | 5/1961 | Germany . |

*Primary Examiner*—James A. Lisehora
*Attorney, Agent, or Firm*—Robert W. Becker & Associates

[57] ABSTRACT

A vehicle for repairing a damaged road surface by filling depressions within the road surface with a filling material has, in a direction of travel, a heating and scraping unit for removing excess road surface material from the road surface. It further has a depositing device for a filling material. A first dynamic compacting device is arranged downstream of depositing device for compacting the filling material to a level higher than a level of an adjacent undamaged area of the road surface. A doctor blade unit is connected to the depositing device so as to act downstream of the first dynamic compacting device onto the filling material for removing excess filling material. The doctor blade unit pivots horizontally in a direction perpendicular to the direction of travel. The doctor blade unit is vertically adjustable relative to the first dynamic compacting device and the depositing device. A second dynamic compacting device is arranged downstream of the doctor blade unit.

11 Claims, 2 Drawing Sheets

VEHICLE FOR REPAIRING ROAD SURFACES

BACKGROUND OF THE INVENTION

The invention relates to a vehicle for repairing damaged road surfaces, especially of pot holes, ruts, and unevenness, by compensating (filling, coating) with a filling material such as asphalt etc., comprised of a heating and scraping unit, a depositing device for the filling material, and a dynamically acting compacting device, arranged downstream of the depositing device, for compacting the scraped material and the added filling material downstream of the depositing device to a level that is higher than the level of the neighboring undamaged road surface and with a doctor blade unit, positioned downstream of the compacting device and, in operation, reciprocating transverse to the direction of travel for removal of deposited filling material downstream of the compacting device.

A repair vehicle of this kind is described in European application 560 021.

With the known vehicle according to European application 560 021 numerous experiments have been performed which experiments showed as a result that, depending on the application, on the repaired road surface air pockets of up to 2 cm depth will result with a total volume of approximately 3 to 5% and, therefore, non-reproducible compacting results are obtained.

The term "air pockets" refers to empty space within the work surface around a solid granular component or positioned adjacent thereto in any other orientation, which results from the solid particle being rolled or dragged by the horizontally acting doctor blade unit which reciprocates in a direction transverse to the direction of travel but also moves in the direction of travel whereby the remaining empty space is not filled downstream of the doctor blade unit by known vehicles.

The test results further showed that the air pockets with increasing granular size and granular distribution within the surface to be repaired would also increase.

Such air pockets cannot always and with all applications be eliminated with subsequent compacting work, for example, with a separate compacting device, with the required quality as well as personnel-independent in a reproducible and economic manner because in a subsequent compacting step the following important conditions can not always be fulfilled;

postponement, which, especially for thin layers, results in a fast, uncontrollable temperature reduction of the bituminous material to be compacted, which, in turn, makes it questionable that the desired degree of compacting will be reached, in order to eliminate the already present air pockets during a subsequent compacting step and in order to level the road surface to be repaired with the undamaged road surface in a flush manner, an exact, metered feed of material is required which must correspond to the total volume of the air pockets.

The aforementioned required conditions are not fulfillable for subsequent compacting steps and are economically not feasible.

It is an object of the invention to improve the known repair vehicle according to European application 560 021 such that with only smallest remaining air pockets a reproducible and homogenous compacting can be achieved which upon local repair of road surface damage results in a flush connection to the undamaged road surface and, in the case of new coatings of entire road surfaces, ensures a preset level and a preset layer thickness.

SUMMARY OF THE INVENTION

The aforementioned object is inventively solved in that the doctor blade unit is connected to the depositing device so as to be height adjustable in a controlled manner independent of the depositing device and the compacting device and that at the vehicle behind the doctor blade unit in its vicinity a further dynamically acting compacting device is arranged.

The vehicle for repairing a damaged road surface by filling depressions within a filling material according to the present invention is primarily characterized by the following features viewed in the direction of the vehicle:

a heating and scraping unit for removing excess road surface material from the road surface;

a depositing device for a filling material;

a first dynamic compacting device arranged downstream of the depositing device for compacting the filling material to a level higher than a level of an adjacent undamaged area of the road surface;

a doctor blade unit connected to the depositing device so as to act downstream of the first dynamic compacting device onto the filling material for removing excess filling material, the doctor blade unit reciprocate horizontally in a direction perpendicular to the direction of travel;

the doctor blade unit being vertically adjustable relative to the first dynamic compacting device and the depositing device;

a second dynamic compacting device arranged downstream of the doctor blade unit.

The depositing device has a working chamber with a rear wall, delimiting the depositing device relative to the second dynamic compacting device, and with sidewalls. The doctor blade unit is connected to the rear wall and the rear wall is connected to the sidewalls so as to be vertically adjustable such that a gap between the undamaged road surface and a lower edge of the doctor blade unit is adjustable.

A working width of the second compacting device is identical to a working width plus a reciprocating range of the doctor blade unit.

The second dynamic compacting device comprises a means for exerting high-frequency compressive stress and shearing stress onto the filling material while maintaining constant contact with the road surface.

The second dynamic compacting device is preferably a vibratory roller.

The vibratory roller comprises a drive motor so as to be self-propelling and the drive motor further drives the entire vehicle.

The doctor blade unit and the second dynamic compacting are spaced at a minimal distance from one another.

The second dynamic compacting device further comprises a travel sensor for detecting a vertical displacement between the damaged road surface and a repaired road surface downstream of the second dynamic compacting device. The vehicle further comprises a control unit for controlling a vertical position of the doctor blade at the depositing device. The control unit comprises: a transducer for sending a first signal as a nominal value; a comparator connected to the transducer and to the travel sensor, the comparator comparing the nominal value to a second signal to give a comparison value; an amplifier, connected to the comparator, for amplifying the comparison value; a control member, connected to the amplifier, for positioning, when the comparison value surpasses a preset threshold, the doctor blade unit as a function of the comparison value; and wherein the second signal is an arithmetic mean of the vertical displacements.

The second dynamic compacting device is a vibratory roller with an axis of rotation. The travel sensor comprises two sensing elements each comprising a fastener, wherein the sensing elements are connected with the fasteners to opposite ends of the vibratory roller on the axis of rotation so as to extend perpendicularly to the road surface.

The invention also relates to a method for operating the inventive vehicle for repairing a damaged road surface by filling depressions within the road surface with a filling material. The method is primarily characterized by the following step:

controlling a vertical position of the doctor blade unit such that the filling material compacted by the first compacting device is removed by the doctor blade unit only to a first level above a second level, resulting as an actual road surface level downstream of the second dynamic compacting device, that the amount of filling material, defined by the difference between the first and the second level, is sufficient to fill air pockets during compacting with the second dynamic compacting device.

The method may further comprise the steps of:

continuously measuring a vertical difference between the damaged road surface and the repaired road surface after compacting with the second dynamic compacting device;

comparing the vertical difference to a preset nominal value to give a comparison value;

adjusting the vertical position of the doctor blade unit as a function of the comparison value in order to match the vertical difference to the nominal value.

In the inventive repaired tool, the vertical position of the doctor blade unit is controllable in such a manner that downstream of the doctor blade unit, reciprocating horizontally transverse to the direction of travel, still a small amount of excess material remains above the level of the undamaged part of the road surface, respectively, the desired level of the new coating which amount is such that it substantially is just sufficient for closing air pockets produced behind the doctor blade unit in the subsequently performed additional compacting step with the further compacting tool so that behind the further compacting tool a smooth, homogenous, repaired road surface is present that has the desired level.

With the method for operating the inventive vehicle a repaired road surface will be obtained behind the further compacting tool in which; locally limited repaired areas have the same vertical level as undamaged areas of the original road surface or, in the case of a complete new coating, a desired pre-adjusted height level relative to the original road surface is obtained whereby in each case practically no air pockets will remain.

BRIEF DESCRIPTION OF THE DRAWINGS

The invention will subsequently be explained in more detail with the aid of the drawings in which one embodiment is shown.

It is shown in the drawings in.

DESCRIPTION OF PREFERRED EMBODIMENTS

Figure 1:
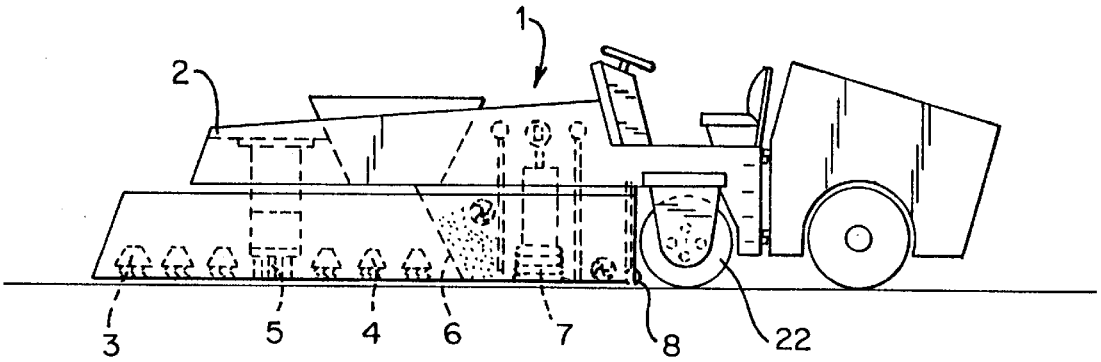
FIG. 1 a side view of a preferred embodiment of the inventive vehicle.

FIG. 1 shows a steerable repair vehicle 1 that at its forward end 2 comprises a plurality of heating devices 3 and 4. Between the heating devices 3 and 4 a scraping device 5 for scraping the surface of the pre-heated, partly damaged road surface. Downstream thereof a depositing device 6 is arranged which is filled with heated asphalt for a similar filling material which device deposits the filling material onto the road surface to be repaired, and downstream thereof a compacting device 7 is provided adjacent to which a height-adjustable doctor blade unit 8 is positioned which is height adjustable independent of the depositing device.

At the rearward part of the vehicle 1 the drive motor and the gas cylinders for supplying the heating devices 3 and 4 are arranged. When using the device for a new coating of entire street surfaces, the heating devices 3 and 4 and the scraping device 5 are not being used.

Figure 2:
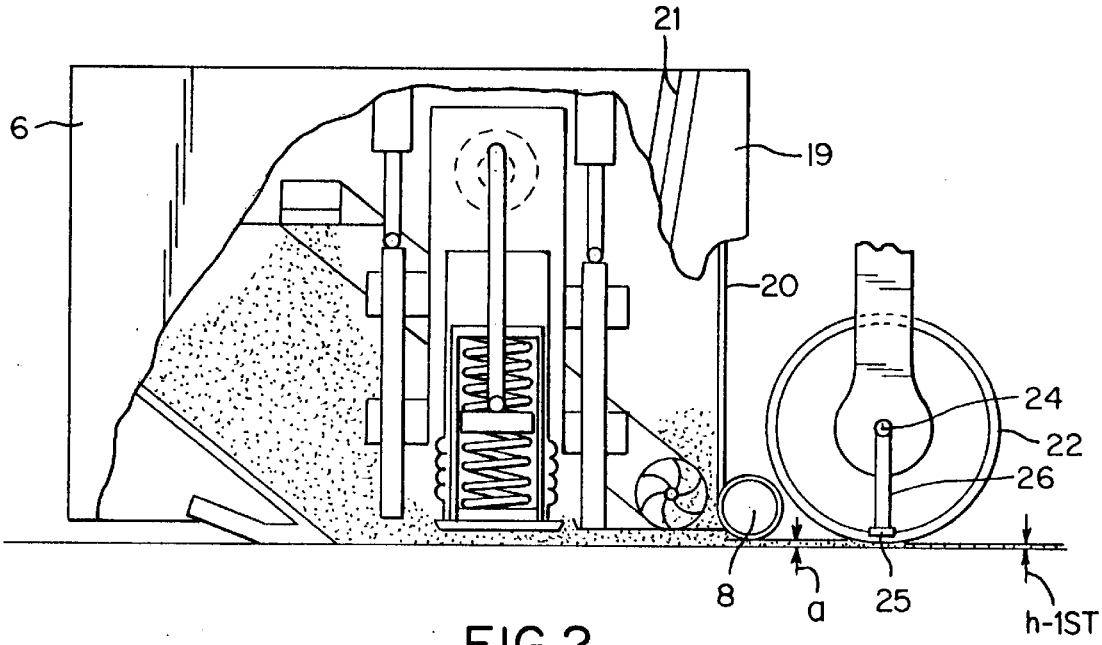
FIG. 2 a part-sectional enlarged side view of the vehicle according to FIG. 1.

As can be seen especially in the enlarged representation of FIG. 2, a further compacting device 22, preferably in the form of a vibratory roller, is positioned downstream of the doctor blade unit 8 with smallest possible spacing to the doctor blade unit, whereby its width corresponds to the working width of the doctor blade unit 8 plus its reciprocating stroke. The compacting device 22 is provided with a vibration generating system which imparts to the bituminous area to be compacted a balanced combination of dynamic shearing stress and high-frequency compressive stress in such a manner that it never loses its contact with the material to be compacted. In the embodiment as a vibratory roller, the further compacting device 22 may be provided with a non-represented drive motor, that can be switched on and off, which also serves as a drive unit for the compacting device 22 and optionally also as a drive unit for the entire vehicle 1.

In contrast to the known vehicle according to European application 560 021 the depositing device 6 in connection with the doctor blade unit 8 has the following particularities:

The doctor blade unit 8 is fixedly connected to a rear wall 20 of the depositing device 6 which delimits the working area relative to the further compacting device 22 and, together with the rear wall 20, is connected to the sidewalls 19 of the depositing device 6 such that, in a vertical direction, it can be adjusted with a precision of one tenth of a millimeter. This adjustment process can, for example, be performed with an electric motor 33 (FIG. 3) not represented in FIG. 1 or FIG. 2 or hydraulically or manually.

Before beginning the repair work or the new coating of entire road surfaces, a gap a of only a few millimeters is adjusted, based on practical experience as a function of the granule size and granule distribution of the filling material, between the doctor blade unit 8 and the undamaged part of the road surface, respectively, between the doctor blade 8 and the required level of the new road surface. The size of the adjusted gap a corresponds volume-wise almost identically to the air pockets within the surface area still to be compressed located between the doctor blade 8 and the further compacting device in the form of a vibratory roller 22. After this basic adjustment of the doctor blade unit 8 a correction of the adjusted gap a is only necessary when, for example, upon performing repair work, the actual gap or distance "h-ACTUAL" between the vibratory roller 22 and the undamaged road surface is greater or smaller than the pre-selected reliable gap or distance "h-NOMINAL" which can be within a range of tenths of a millimeter.

For continuously measuring the actual gap a from the value h-ACTUAL a travel sensor 25 with two sensing elements is connected with fastening elements 26 to both sides of the axis of rotation 24 of the vibratory roller 22 such that both sensing elements of the travel sensor 25 are positioned perpendicular to the road surface to be repaired or to be newly coated, whereby this position is maintained.

On the other hand, the two sensing elements of the travel sensor 25 are electronically designed such that a continuously arithmetic mean of the measured signals is determined.

Figure 3:
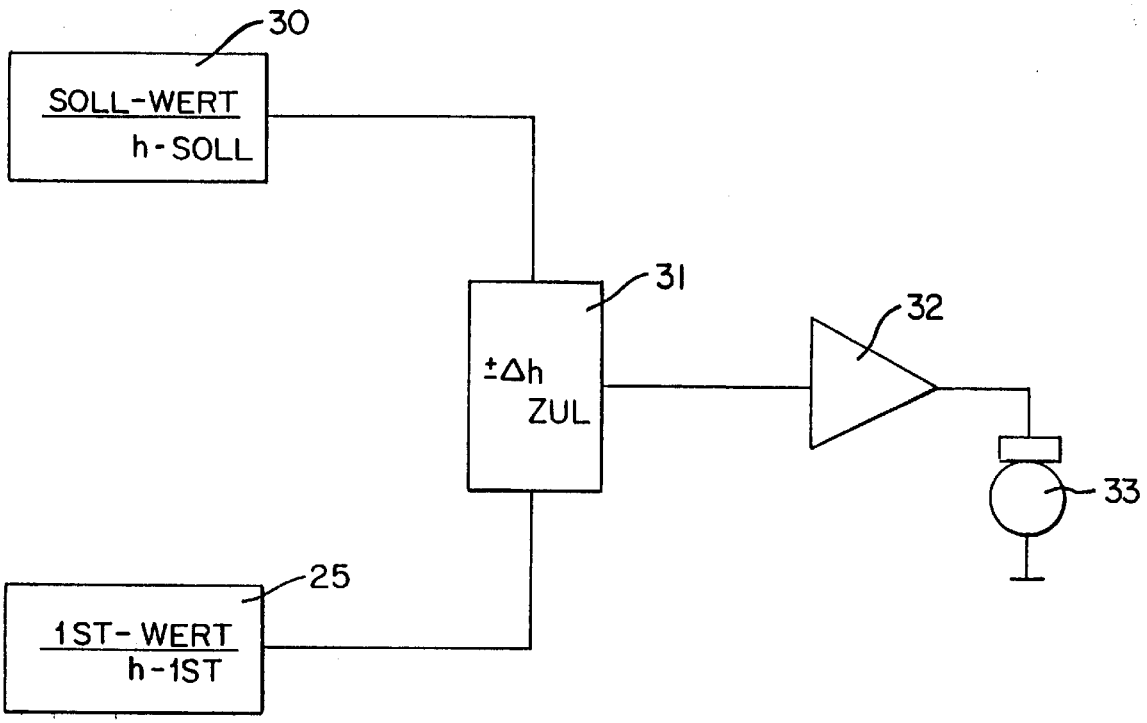
FIG. 3 a schematic representation of the control process for the gap a between the original road surface and the doctor blade unit.

FIG. 3 shows an expedient further embodiment of the inventive vehicle with a control process that ensures reaching and maintaining the value h-NOMINAL. This control process is performed with a control circuit comprising a comparator 31 that receives, on the one hand, the arithmetic mean of the signals of the sensing elements of the travel sensor 25 connected to the axis of rotation for the actual gap h-ACTUAL and, on the other hand, signals from a transducer 30 that serves for selecting the value h-NOMINAL. Upon surpassing a certain difference between the two signals, i.e., a certain surpassing in the positive or negative manner of the width of the gap a, a control member 33, for example, an electric motor, is activated via an amplifier 32 for increasing or decreasing the gap a until the actual gap, respectively, the actual vertical distance h-ACTUAL corresponds to the adjusted gap value h-NOMINAL. Thus, an automatic adjustment for realizing a homogenous and prescribed compacting and furthermore a repair work with a flush connection to the undamaged area of the road surface, respectively, in the case of new coatings of entire road surfaces, a predescribed level with a certain layer thickness is achieved.

The present invention is, of course, in no way restricted to the specific disclosure of the specification and drawings, but also encompasses any modifications within the scope of the appended claims.

What I claim is:

1. A vehicle for repairing a damaged road surface by filling depressions within the road surface with a filling material; said vehicle, in a direction of travel, comprising:

a heating and scraping unit for removing excess road surface material from the road surface;

a depositing device for a filling material;

a first dynamic compacting device arranged downstream of said depositing device for compacting the filling material to a level higher than a level of an adjacent undamaged area of the road surface;

a doctor blade unit connected to said depositing device so as to act downstream of said first dynamic compacting device onto the filling material for removing excess filling material, said doctor blade unit reciprocating horizontally in a direction perpendicular to said direction of travel;

said doctor blade unit being vertically adjustable relative to said first dynamic compacting device and said depositing device;

a second dynamic compacting device arranged downstream of said doctor blade unit.

2. A vehicle according to claim 1, wherein said depositing device has a working chamber with a rear wall, delimiting said depositing device relative to said second dynamic compacting device, and with sidewalls, said doctor blade unit connected to said rear wall and said rear wall connected to said sidewalls so as to be vertically adjustable such that a gap between the undamaged road surface and a lower edge of said doctor blade unit is adjustable.

3. A vehicle according to claim 2, wherein a working width of said second compacting device is identical to a working width plus a reciprocating range of said doctor blade unit.

4. A vehicle according to claim 1, wherein said second dynamic compacting device has a vibration generating system adapted to exert high-frequency compressive stress and shearing stress onto the filling material while maintaining constant contact with the road surface.

5. A vehicle according to claim 1, wherein said second dynamic compacting device is a vibratory roller.

6. A vehicle according to claim 5, wherein said vibratory roller comprises a drive motor so as to be self-propelling and wherein said drive motor further drives said entire vehicle.

7. A vehicle according to claim 1, wherein said doctor blade unit and said second dynamic compacting device are spaced at a minimal distance from one another.

8. A vehicle according to claim 2, wherein said second dynamic compacting device further comprises a travel sensor for detecting a vertical displacement between the damaged road surface and a repaired road surface downstream of said second dynamic compacting device, said vehicle further comprising a control unit for controlling a vertical position of said doctor blade at said depositing device, said control unit comprising:

a transducer for sending a first signal as a nominal value;

a comparator connected to said transducer and to said travel sensor;

said comparator comparing said nominal value to a second signal to give a comparison value;

an amplifier, connected to said comparator, for amplifying said comparison value;

a control member, connected to said amplifier, for positioning, when said comparison value surpasses a preset threshold, said doctor blade unit as a function of said comparison value;

wherein said second signal is an arithmetic mean of said vertical displacements.

9. A vehicle according to claim 8, wherein:

said second dynamic compacting device is a vibratory roller with an axis of rotation;

said travel sensor comprises two sensing elements each comprising a fastener, wherein said sensing elements are connected with said fasteners to opposite ends of said vibratory roller on said axis of rotation so as to extend perpendicularly to the road surface.

10. A method for operating a vehicle for repairing a damaged road surface by filling depressions within the road surface with a filling material; said vehicle, in a direction of travel, comprising: a heating and scraping unit for removing excess road surface material from the road surface; a depositing device for a filling material; a first dynamic compacting device arranged downstream of said depositing device for compacting the filling material to a level higher than a level of an adjacent undamaged area of the road surface; a doctor blade unit connected to said depositing device so as to act downstream of said dynamic compacting device onto the filling material for removing excess filling material, said doctor blade unit reciprocating horizontally in a direction perpendicular to said direction of travel; said doctor blade unit vertically adjustable relative to said dynamic compacting device and said depositing device; a second dynamic compacting device arranged downstream of said doctor blade unit; said method comprising the step of:

controlling a vertical position of said doctor blade unit such that the filling material compacted by said first compacting device is removed by said doctor blade unit only to a first level above a second level, resulting as an actual road surface level downstream of said second dynamic compacting device, that the amount of filling material, defined by the difference between said first and said second level, is sufficient to fill air pockets during compacting with said second dynamic compacting device.

11. A method according to claim 10, further comprising the steps of:

continuously measuring a vertical difference between the damaged road surface and the repaired road surface after compacting with said second dynamic compacting device;

comparing the vertical difference to a preset nominal value to give a comparison value;

adjusting the vertical position of said doctor blade unit as a function of said comparison value in order to match said vertical difference to said nominal value.

* * * * *